US008923711B2

(12) United States Patent
Handa

(10) Patent No.: US 8,923,711 B2
(45) Date of Patent: Dec. 30, 2014

(54) IMAGE FORMING APPARATUS CONFIGURED TO CONTROL A TRANSFER BIAS

(75) Inventor: Hiroshi Handa, Aisai (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 274 days.

(21) Appl. No.: 13/362,723

(22) Filed: Jan. 31, 2012

(65) Prior Publication Data

US 2012/0251139 A1 Oct. 4, 2012

(30) Foreign Application Priority Data

Mar. 29, 2011 (JP) ..... 2011-072897

(51) Int. Cl.
*G03G 15/00* (2006.01)
*G03G 15/16* (2006.01)
*G03G 15/02* (2006.01)

(52) U.S. Cl.
CPC ..... *G03G 15/1675* (2013.01); *G03G 15/0266* (2013.01)
USPC ..... 399/44

(58) Field of Classification Search
CPC ..... G03G 15/1675; G03G 15/0266
USPC ..... 399/44, 46, 56
See application file for complete search history.

(56) References Cited

U.S. PATENT DOCUMENTS 6,134,395 A * 10/2000 Sasaki et al. ..... 399/46
6,219,505 B1 4/2001 Sato et al.
2001/0028813 A1 10/2001 Nishimura et al.
2001/0031154 A1 10/2001 Sato et al.
2003/0049043 A1 3/2003 Fuwazaki et al.

FOREIGN PATENT DOCUMENTS

JP H11-143151 A 5/1999
JP 2000-242104 A 9/2000
JP 2000-267537 A 9/2000
JP 2001-356537 A 12/2001
JP 2005-099645 A 4/2005

OTHER PUBLICATIONS

Machine translation of reference Nakahara et al. (Pub No. JP 11-143,151 A), Pub date May 28, 1999.*
Machine translation of reference Yoshiyama et al. (Pub No. JP 2001-356,537 A), Pub date Dec. 26, 2001.*
Japan Patent Office, Notification of Reasons for Refusal for Japanese Patent Application No. 2011-072897 (counterpart Japanese patent application), dispatched Mar. 19, 2013.

* cited by examiner

*Primary Examiner* — Walter L Lindsay, Jr.
*Assistant Examiner* — Rodney Bonnette
(74) *Attorney, Agent, or Firm* — Merchant & Gould PC

(57) ABSTRACT

An image forming apparatus including: a photosensitive member; a charging member; a developer carrier; a transfer member; a charging control unit that applies a charging bias having the same polarity as a charged polarity of the developers to the charging member; and a transfer control unit that applies a transfer bias having a reverse polarity to the charged polarity of the developers to the transfer member, wherein when the transfer control unit sets the absolute value of the transfer bias to a first value, the charging control unit sets an absolute value of the charging bias to a third value, and wherein when the transfer control unit sets the absolute value of the transfer bias to a second value, the charging control unit sets the absolute value of the charging bias to a fourth value smaller than the third value.

6 Claims, 5 Drawing Sheets

1/5

IMAGE FORMING APPARATUS CONFIGURED TO CONTROL A TRANSFER BIAS

CROSS-REFERENCE TO RELATED APPLICATIONS

This application claims priority from Japanese Patent Application No. 2011-072897 filed on Mar. 29, 2011, the entire contents of which are incorporated herein by reference.

TECHNICAL FIELD

The invention relates to an image forming apparatus configured to control a transfer bias.

BACKGROUND

In general, there is known an image forming apparatus of an electrophotographic type, in which a transfer bias (transfer voltage) having a polarity different from a charged polarity of developers is applied to a transfer roller arranged to face a photosensitive member, thereby transferring a developer image formed on the photosensitive member to a recording sheet positioned between the photosensitive member and the transfer roller. In the known image forming apparatus, as a resistance value of the sheet is lowered under high-humidity environments, more current than usual flows between the photosensitive roller and the transfer roller, so that the charges of the developers on the photosensitive member are neutralized. Regarding this, one related-art image forming apparatus has been known which under high-humidity environments, performs a printing operation with the transfer bias being reduced, thereby preventing much current from flowing between the photosensitive member and the transfer roller.

In the meantime, another related-art image forming apparatus of a cleanerless type has been known in which the developers remaining on the photosensitive member without being transferred to the recording sheet are collected by a developing roller and the collected developers are reused. In the other related-art image forming apparatus, the developers remaining on the photosensitive member are collected by the developing roller by using a difference between a surface potential of the photosensitive member and a developing bias (developing voltage) applied to the developing roller.

SUMMARY

In the one related-art image forming apparatus, when control of lowering the transfer bias is performed by mistake under non high-humidity environments, the potential difference between the surface of the photosensitive member and the surface of the transfer roller is reduced, so that the toners are not sufficiently transferred. In particular, it is not possible to express a thin line or a minute point, so that an image quality is deteriorated. Regarding this, a method of lowering the charging bias all the time to prevent the deterioration of the image quality is considered. However, when this technology is adopted in the other related-art image forming apparatus, it becomes difficult to collect the developers, which remain on the photosensitive member without being transferred, by the developing roller, so that the developers remain on the photosensitive member. As a result, a problem occurs with regard to the image formation.

Accordingly, an object of the invention is to provide an image forming apparatus of a cleanerless type capable of suppressing deterioration of an image quality.

According to an aspect of the invention, there is provided an image forming apparatus including: a photosensitive member having a surface on which an electrostatic latent image is formed; a charging member that charges the photosensitive member; a developer carrier that supplies developers to the electrostatic latent image on the photosensitive member; a transfer member that transfers the developers on the photosensitive member to a transfer medium by nipping the transfer medium between the photosensitive member; a charging control unit that applies a charging bias having the same polarity as a charged polarity of the developers to the charging member; and a transfer control unit that applies a transfer bias having a reverse polarity to the charged polarity of the developers to the transfer member, wherein the image forming apparatus collects developers, which remain on the photosensitive member without being transferred to the transfer medium, by the developer carrier and reuses the collected developers, wherein the transfer control unit is configured to set an absolute value of the transfer bias to a first value or a second value smaller than the first value, wherein when the transfer control unit sets the absolute value of the transfer bias to the first value, the charging control unit sets an absolute value of the charging bias to a third value, and wherein when the transfer control unit sets the absolute value of the transfer bias to the second value, the charging control unit sets the absolute value of the charging bias to a fourth value smaller than the third value.

According to the image forming apparatus configured as described above, the charging control unit reduces the charging bias only when the transfer control unit reduces the transfer bias. Therefore, it is possible to minimize an amount of the developers which are not collected by the developer carrier to the minimum so that it is possible to solve the printing problem.

According to the invention, it is possible to suppress the deterioration of the image quality in the image forming apparatus of the cleanerless type.

BRIEF DESCRIPTION OF DRAWINGS

FIG. 4 shows a surface potential of a photosensitive member, a developing bias and a transfer bias when printing a thin line, in which

DETAILED DESCRIPTION

Hereinafter, an illustrative embodiment of the invention will be specifically described with reference to the drawings. In the descriptions hereinafter, an overall configuration of a laser printer 1 (image forming apparatus) is first briefly described and then characteristics of the invention are described.

In the descriptions hereinafter, the directions are described based on a user who uses the laser printer 1. That is, in FIG. 1, the right side of the sheet is referred to as the front side and the left side of the sheet is referred to as the rear side. The front side in a direction perpendicular to the sheet is referred to as the left side and the back side in a direction perpendicular to the sheet is referred to as the right side. The upper-lower direction of the sheet is referred to as the upper-lower direction.

<Overall Configuration of Laser Printer>

Figure 1:
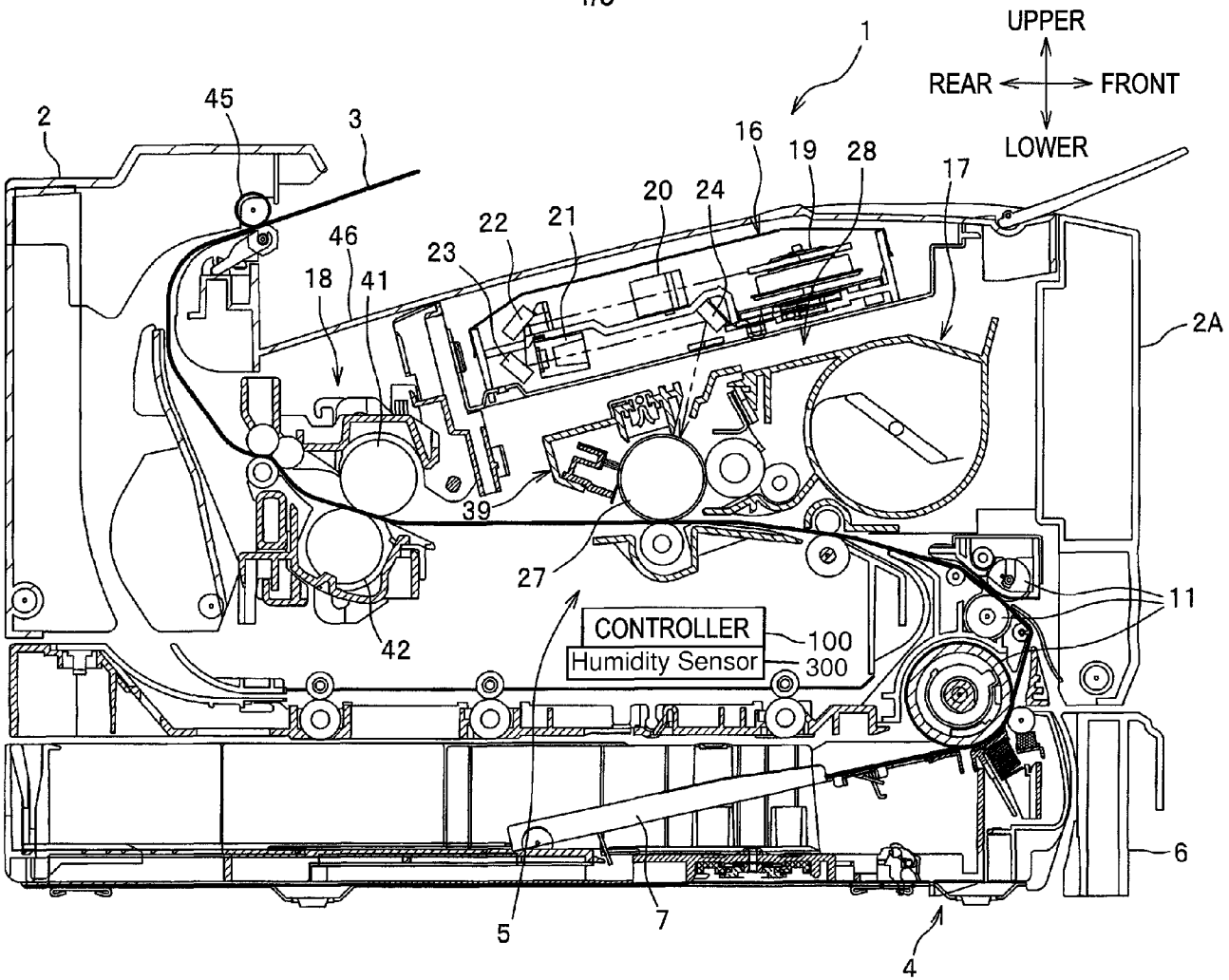
FIG. 1 is a side sectional view showing a laser printer according to an illustrative embodiment of the invention.

As shown in FIG. 1, the laser printer 1 has, in an apparatus main body 2, a feeder unit 4 that feeds a sheet 3, which is an example of the recording sheet (transfer medium), an image forming unit 5 that forms an image on the sheet 3, and the like.

The feeder unit 4 has a sheet feeding tray 6 that is detachably mounted to a lower part in the apparatus main body 2, a sheet pressing plate 7 provided in the sheet feeding tray 6 and a variety of rollers 11 for conveying the sheet 3. The sheet 3 accommodated in the sheet feeding tray 6 is oblique upward by the sheet pressing plate 7 and is conveyed to the image forming unit 5 by the various rollers 11.

The image forming unit 5 has a scanner unit 16, a developing unit 17, a fixing unit 18, a controller 100 and the like.

The scanner unit 16 is provided at an upper part in the apparatus main body 2. Laser light based on image data passes through a polygon mirror 19, lenses 20, 21, reflectors 22, 23, 24 and the like (refer to dashed-two dotted line) and is illuminated on a surface of a photosensitive drum 27 by high-speed scanning.

The developing unit 17 is configured to be detachably mounted to the apparatus main body 2 by opening a front cover 2A provided at the front of the apparatus main body 2. The developing unit 17 is mainly configured by a developing cartridge 28 and a drum unit 39.

The developing cartridge 28 is detachably mounted to the apparatus main body 2 with being mounted to the drum unit 39. In the meantime, the developing cartridge 28 may be detachably mounted to the drum unit 39 that is fixed to the apparatus main body 2.

Figure 2:
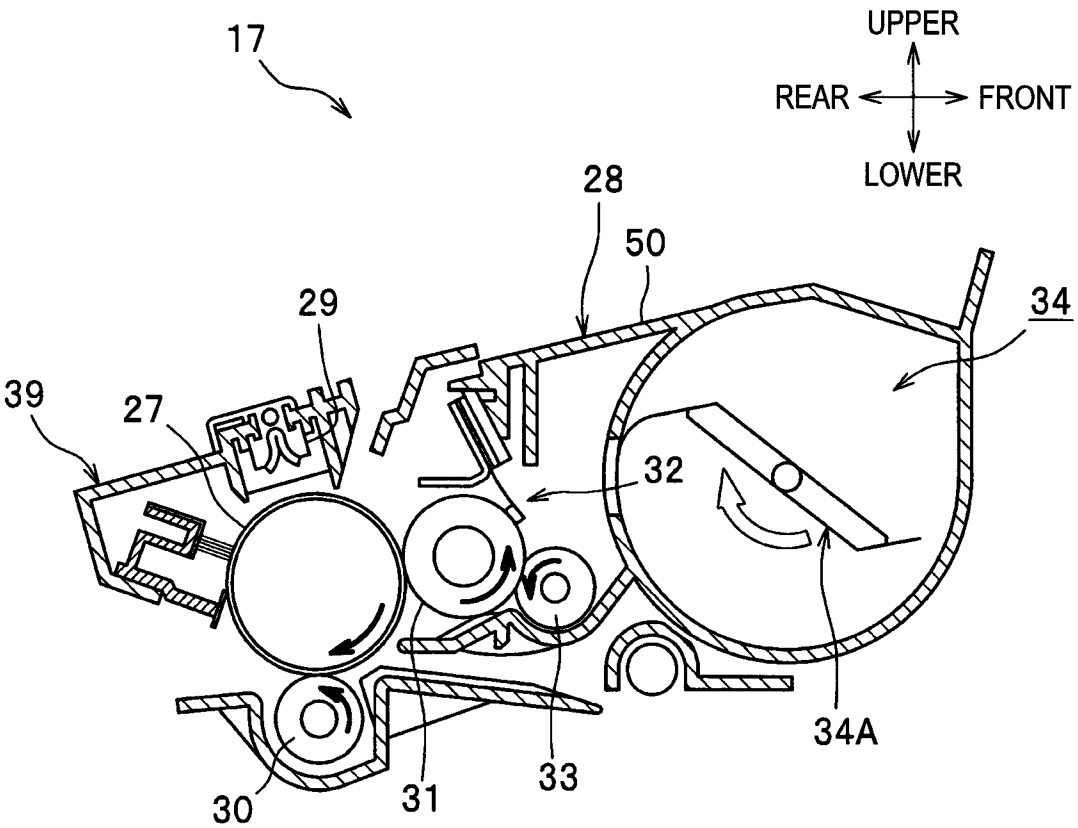
FIG. 2 is a side sectional view showing a developing unit.

As shown in FIG. 2, the developing cartridge 28 has a developing frame 50, a developing roller 31, which is an example of the developer carrier, a layer thickness regulation blade 32 and a supply roller 33. The developing frame 50 is formed with a toner accommodation chamber 34.

In the developing cartridge 28, toners, which is an example of the developers, in the toner accommodation chamber 34 are stirred by an agitator 34A and are then supplied to the developing roller 31 by the supply roller 33. At this time, the toners are positively friction-charged between the supply roller 33 and the developing roller 31. As the developing roller 31 is rotated, the toners supplied onto the developing roller 31 are introduced between the layer thickness regulation blade 32 and the developing roller 31 and are then carried on the developing roller 31 as a thin layer having a predetermined thickness while being further friction-charged.

The drum unit 39 mainly has a photosensitive drum 27 that is an example of the photosensitive member, a scorotron-type charger 29 that is an example of the charging member and a transfer roller 30 that is an example of the transfer member. In the drum unit 39, a surface of the photosensitive drum 27 is positively charged uniformly by the scorotron-type charger 29 and then exposed by the high-speed scanning of the laser light from the scanner unit 16. Thereby, a potential of the exposed part is lowered, so that an electrostatic latent image based on image data is formed.

Then, as the developing roller 31 is rotated, the positively charged toners carried on the surface of the developing roller 31 are supplied to the electrostatic latent image formed on the surface of the photosensitive drum 27, so that a toner image (developer image) is formed on the surface of the photosensitive drum 27. After that, as the sheet 3 is conveyed between the photosensitive drum 27 and the transfer roller 30, the toner image carried on the surface of the photosensitive drum 27 is transferred onto the sheet 3. At this time, the transfer roller 30 is applied with a transfer bias having a reverse polarity to the charged polarity (positive polarity) of the toners.

As shown in FIG. 1, the fixing unit 18 has a heating roller 41 and a pressing roller 42 that presses the heating roller 41. In the fixing unit 18, the toners transferred onto the sheet 3 are heat-fixed while the sheet 3 passes between the heating roller 41 and the pressing roller 42. In the meantime, the sheet 3 heat-fixed in the fixing unit 18 is conveyed to sheet discharge rollers 45, which are arranged downstream from the fixing unit 18, and then delivered onto a sheet discharge tray 46 from the sheet discharge rollers 45.

Also, the laser printer 1 adopts a so-called cleanerless method of collecting and reusing the toners (hereinafter, referred to as remaining toners), which remain on the photosensitive drum 27 without being transferred to the sheet 3, by the developing roller 31. Specifically, when collecting the remaining toners, the surface of the photosensitive drum 27 is charged by the scorotron-type charger 29, so that the surface potential of the photosensitive drum 27 becomes higher than the potential of the developing roller 31. Thereby, the positively charged toners carried on the photosensitive drum 27 are moved to the developing roller 31 and are returned to the toner accommodation chamber 34.

The controller 100 has a CPU, a RAM, a ROM and the like, which are not shown, and is disposed at an appropriate position in the apparatus main body 2. The controller 100 controls a voltage and the like, which are applied to the transfer roller 30, the scorotron-type charger 29, the developing roller 31 and the like, based on the input image data, a variety of instructions, program or data stored in the ROM and the like, thereby controlling entire operations of the laser printer 1.

<Detailed Configuration of Controller>

Figure 3:
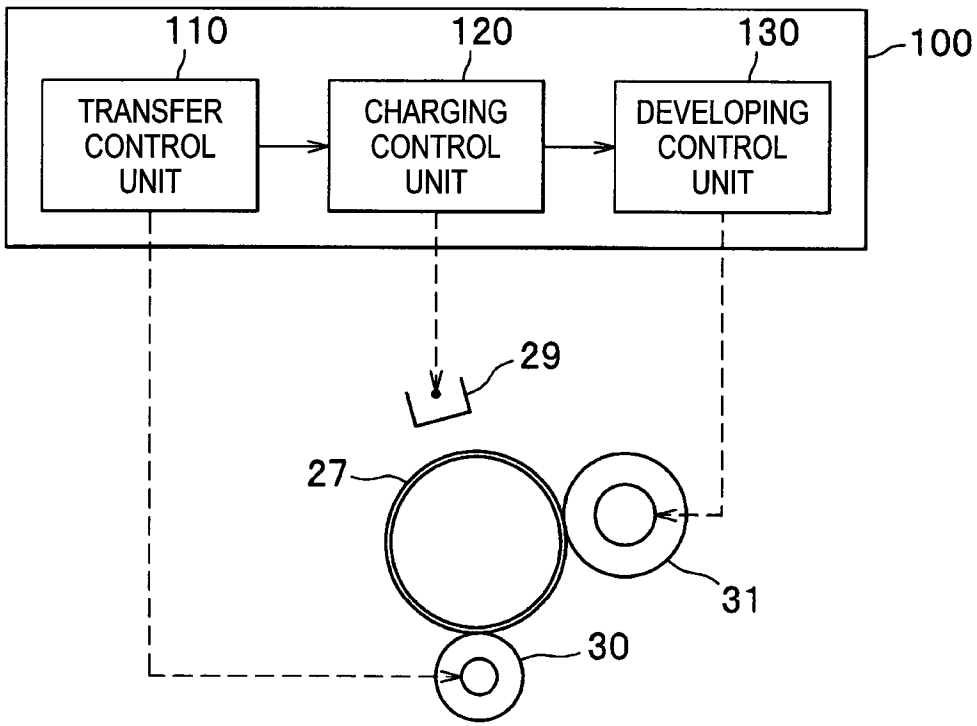
FIG. 3 illustrates voltages being applied from each controller to a developing roller, a charger and a transfer roller, respectively.

As shown in FIG. 3, the controller 100 has a transfer control unit 110, a charging control unit 120 and a developing control unit 130 and is configured to execute a transfer improving mode in response to a signal input by an operation by a user. The transfer improving mode is a mode that is executed when the laser printer 1 is used under high-humidity environments. By executing the transfer improving mode, it is possible to improve transfer defects that are generated under high-humidity environments.

The transfer control unit 110 applies a transfer bias having a reverse polarity to the charged polarity of the toners to the transfer roller 30, based on a printing instruction input to the controller 100. Specifically, the transfer control unit 110 is configured to control the transfer bias to a first transfer bias V1 having an absolute value of a first value during a usual printing pr to a second transfer bias V2 having an absolute value of a second value smaller than the first value during the transfer improving mode. Also, the transfer control unit 110 inputs the value of the transfer bias, which is applied to the transfer roller 30, to the charging control unit 120.

Hereinafter, the reason for controlling the transfer bias as described above will be described.

The transfer bias is a voltage that is applied to the transfer roller 30 so as to transfer the toner image on the photosensitive drum 27 to the sheet 3 being conveyed between the transfer roller 30 and the photosensitive drum 27. In this illustrative embodiment, the transfer bias is potentiostatically controlled. If the transfer bias is always potentiostatically controlled with the first transfer bias V1, under high-humidity environments, since the resistance value of the sheet 3 is lowered, the transfer current flowing between the photosensitive drum 27 and the transfer roller 30 becomes excessive than usual. Thereby, the excessive negative charges flow from the transfer roller 30 to the positively charged toners carried on the photosensitive drum 27, thereby neutralizing the charges of the toners. Thereby, the toners carried on the photosensitive drum 27 are not sufficiently transferred onto the sheet 3, so that the transfer defects such as image fading are generated.

Therefore, in the transfer improving mode, the transfer bias is switched to the second transfer bias V2 having an absolute value smaller than the first transfer bias V1 during the usual printing, so that the potential difference between the surface of the photosensitive drum 27 and the surface of the transfer roller 30 is reduced. Thereby, it is possible to suppress the excessive transfer current from flowing under high-humidity environments. Hence, since it is possible to reduce the neutralization of the toners on the photosensitive drum 27, it is possible to prevent the transfer defects.

The charging control unit 120 is configured to apply a charging bias having the same polarity as the charged polarity of the toners to the scorotron-type charger 29, based on the value of the transfer bias input from the transfer control unit 110, and controls the charging bias to control the surface potential of the photosensitive drum 27.

Specifically, when the transfer control unit 110 sets the transfer bias to the first transfer bias V1, the charging control unit 120 sets, as the charging bias, a first charging bias V3 having an absolute value of a third value. When the transfer control unit 110 sets the transfer bias to the second transfer bias V2, the charging control unit 120 sets, as the charging bias, a second charging bias V4 having an absolute value of a fourth value smaller than the third value. Thereby, it is possible to control the surface potential of the photosensitive drum 27 in response to the transfer bias. In the meantime, the timing at which the charging control unit 120 switches the transfer bias may be the same as the timing at which the transfer control unit 110 switches the transfer bias or may be thereafter or therebefore. Also, the charging control unit 120 inputs the value of the charging bias, which is applied to the scorotron-type charger 29, to the developing control unit 130.

Hereinafter, the reason for controlling the charging bias as described above will be described.

Figure 4A:
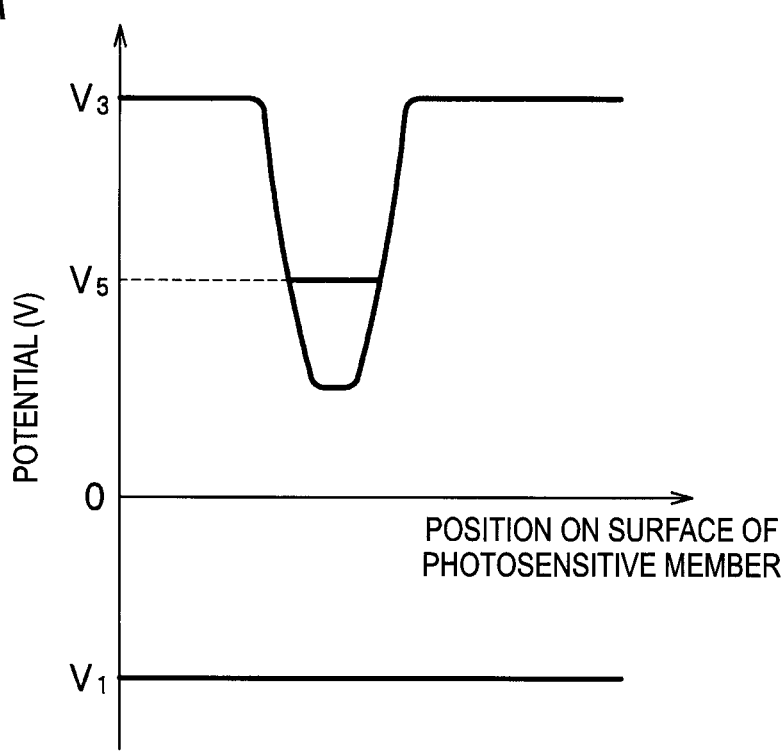
FIG. 4A shows a usual printing and FIG. 4B shows a transfer improving mode.

For example, when the charging bias is set to the first charging bias V3, the photosensitive drum 27 whose surface has been uniformly charged by the scorotron-type charger 29 is exposed by the laser light, so that a potential of the exposed part is lowered, as shown in FIG. 4A. Then, when the developing roller 31 and the photosensitive drum 27 face each other, the toners are moved from the developing roller 31 to an area (an area in which the potential is indicated at a position of V5) on the photosensitive drum 27, in which the potential thereof is lowered below the potential of the developing roller 31.

Figure 4B:
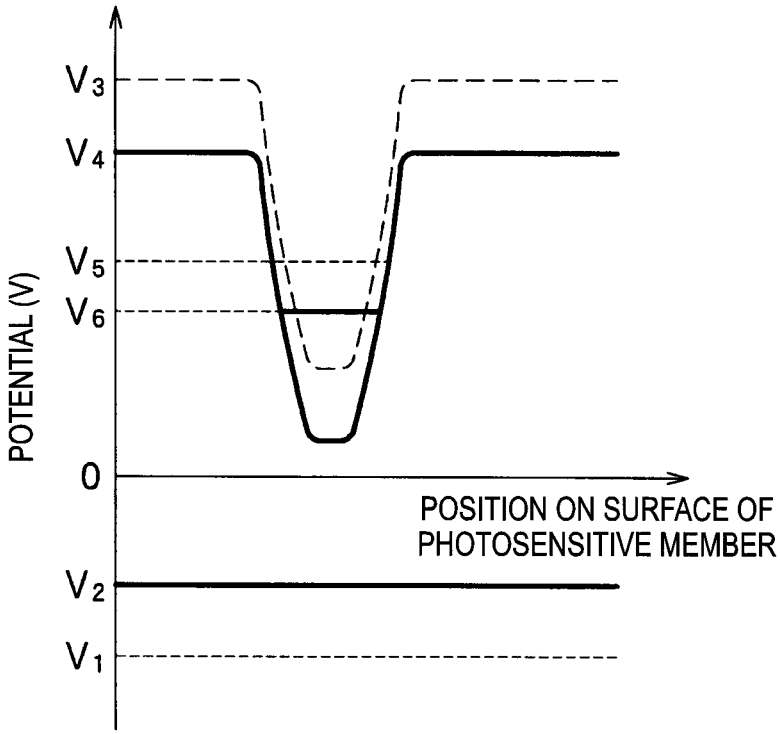

If the charging bias is fixed to the first charging bias V3, when the transfer bias is set to the second transfer bias V2 having an absolute value smaller than the first transfer bias V1, as shown in FIG. 4B, the potential difference between the surface of the photosensitive drum 27 and the surface of the transfer roller 30 becomes smaller, compared to a case where the transfer bias is set to the first transfer bias V1. Under high-humidity environments, the transfer current becomes larger than usual. Thus, even when the potential difference between the surface of the photosensitive drum 27 and the surface of the transfer roller 30 is small, it is possible to sufficiently transfer the toners. However, under low-humidity environments, the transfer current becomes small. Thus, the toners carried on the photosensitive drum 27 are not sufficiently transferred to the sheet 3, so that it is not possible to express a thin line or a minute point. Regarding this, when the transfer bias is set to the second transfer bias V2, the surface potential (charging bias) of the photosensitive drum 27 is lowered to the second charging bias V4, so that the surface potential of the exposed part is also lowered and thus more toners can be carried. Thereby, even when the potential difference between the surface of the photosensitive drum 27 and the surface of the transfer roller 30 is small, it is possible to transfer the toners enough to express a thin line or a minute point to the sheet 3.

Further, in order to simplify the control of the controller 100, a method of controlling the charging bias to the second charging bias V4 all the time is considered. However, when the charging bias is controlled to the second charging bias V4 all the time, the potential difference between the surface of the transfer roller 30 and the surface of the photosensitive drum 27 is also reduced, so that it is difficult to collect the remaining toners with the developing roller 31. When the toners remain on the photosensitive drum 27, a problem occurs with respect to the printing. Thus, when the charging bias is set to the second charging bias V4 only when the transfer bias is set with the second transfer bias V2, it is possible to suppress the printing problem to the minimum.

The developing control unit 130 applies a developing bias having the same polarity as the toners to the developing roller 31 based on the value of the charging bias input from the charging control unit 120. Specifically, when the charging control unit 120 sets the charging bias to the first charging bias V3, the developing control unit 130 applies a first developing bias V5 having an absolute value of a fifth value to the developing roller 31. When the charging control unit 120 sets the charging bias to the second charging bias V4, the developing control unit 130 sets, a second developing bias V6 having an absolute value of a sixth value smaller than the fifth value as the developing bias. In the meantime, the timing at which the developing control unit 130 switches the developing bias may be the same as the timing at which the charging control unit 120 switches the charging bias or may be thereafter or therebefore.

By changing the developing bias depending on the value of the charging bias as described above, it is possible to suppress the toners from being excessively carried on the photosensitive drum 27. As shown in FIG. 4A, when the charging bias is the first charging bias V3 and the developing bias is the first developing bias V5, the toners are moved from the developing roller 31 to the area of the photosensitive drum 27, in which the photosensitive drum is exposed and thus the potential thereof is reduced below the first developing bias V5, as described above. In the meantime, as shown in FIG. 4B, when the charging bias is the second charging bias V4 and the developing bias is the first developing bias V5, since the area of the photosensitive drum 27, in which the potential is lower than the first developing bias V5, is widened, more toners are carried on the photosensitive drum 27. When the toners are excessively carried on the photosensitive drum 27, a printing problem may occur, in that, for example, the toners are carried even on a non-exposed part. Regarding this, when the charging bias is set to the second charging bias V4, the developing bias is set to the second developing bias V6 lower than the first developing bias V5, so that it is possible to prevent the toners from being excessively carried on the photosensitive drum 27. In the meantime, if the developing bias is lowered too much, the thin line and the like become too thin. Accordingly, it is necessary to appropriately lower the developing bias.

<Operations>

Figure 5:
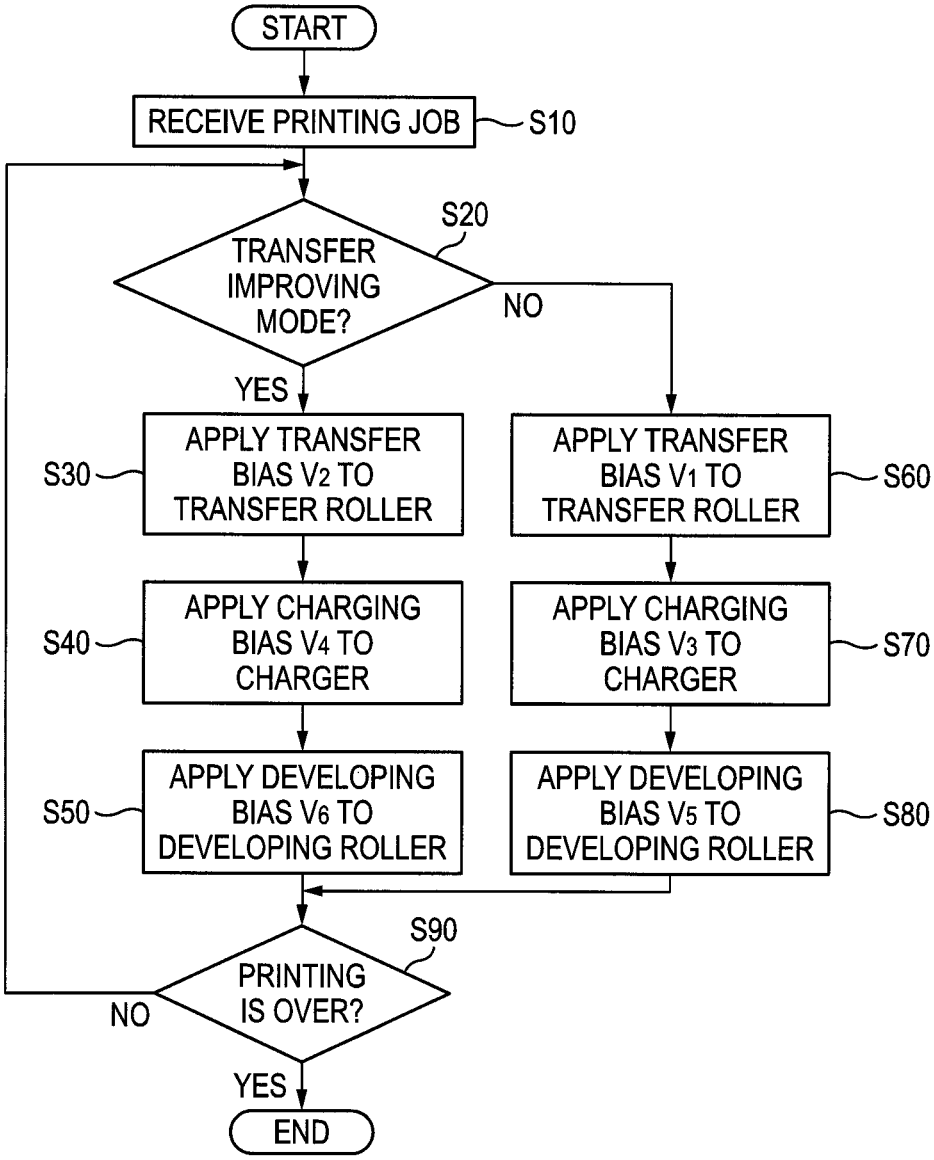
FIG. 5 is a flowchart showing controls to a transfer bias, a charging bias and a developing bias by the controller.

The control operations of the controller 100 configured as described above will be described with reference to FIG. 5.

When a printing job instructing an image formation is transmitted to the laser printer 1 from a personal computer and the like (not shown), the controller 100 receives the printing job (S10). At this time, the controller 100 determines whether a user selects the transfer improving mode (S20).

When it is determined in step S20 that the transfer improving mode is selected (Yes), the controller 100 executes the transfer improving mode. In the transfer improving mode, the transfer control unit 110 first applies the second transfer bias V2 to the transfer roller 30 (S30). Then, the charging control unit 120 applies the second charging bias V4 to the scorotron-type charger 29 (S40) and the developing unit 130 applies the second developing bias V6 to the developing roller 31 (S50).

On the other hand, when it is determined in step S20 that the transfer improving mode is not selected (No), the transfer control unit 110 of the controller 100 first applies the first transfer bias V1 to the transfer roller 30 (S60). Then, the charging control unit 120 applies the first charging bias V3 to the scorotron-type charger 29 (S70) and the developing control unit 130 applies the first developing bias V5 to the developing roller 31.

Then, the controller 100 determines whether or not to end the printing after step S50 or S80 (S90). When it is determined in step S90 that the printing is ended (Yes), the controls of the transfer bias, the charging bias and the developing bias by the controller 100 are over. On the other hand, when it is determined in step S90 that the printing is not ended (No), the controller 100 returns to step S20 and controls the transfer bias, the charging bias and the developing bias, thereby continuing the printing.

As described above, according to this illustrative embodiment, the following effects can be achieved.

The laser printer 1 can control the transfer bias to the first transfer bias V1 having an absolute value of the first value and the second transfer bias V2 having an absolute value of the second value smaller than the first value by the transfer control unit 110. Also, the charging control unit 120 sets the charging bias to the second charging bias V4 having an absolute value of the fourth value smaller than the third value only when the transfer bias is the second transfer bias V2 having an absolute value of the second value smaller than the first value. Accordingly, it is possible to suppress the amount of remaining toners, which are not collected by the developing roller 31, to the minimum, thereby reducing the printing problem.

Further, when the charging bias is set with the second charging bias V4, the developing control unit 130 sets the developing bias to the second developing bias V6 having an absolute value of the sixth value smaller than the fifth value. Thus, it is possible to prevent the toners from being excessively carried on the photosensitive drum 27.

Also, since the transfer control unit 110 switches the transfer bias in response to the signal that is input by an operation by the user, the user can manually switch the transfer bias.

Although the illustrative embodiment of the invention has been described, the invention is not limited to the illustrative embodiment. The specific configuration may be appropriately changed without departing from the gist of the invention.

In the above-described illustrative embodiment, the scorotron-type charger 29 has been adopted as an example of the charging member. However, the invention is not limited thereto. For example, a corotron-type charger may be adopted as an example of the charging member.

In the above-described illustrative embodiment, the transfer improving mode is switched in response to the signal input by the operation by the user. However, the invention is not limited thereto. For example, it may be possible that a humidity sensor 300 is provided in the apparatus main body 2 and the controller 100 executes the transfer improving mode when the humidity sensor detects humidity of a predetermined value or larger.

In the above-described illustrative embodiment, the sheet 3 such as cardboard, postcard and thin sheet has been adopted as an example of the transfer medium. However, the invention is not limited thereto. For example, an intermediate transfer belt may be adopted as the transfer medium.

In the above-described illustrative embodiment, the invention has been applied to the laser printer 1. However, the invention is not limited thereto. For example, the invention may be applied to the other image forming apparatuses such as color printer, copier, multi-function machine, and the like.

What is claimed is:

1. An image forming apparatus comprising:

a photosensitive member having a surface on which an electrostatic latent image is formed;

a charging member configured to charge the photosensitive member;

a developer carrier configured to supply developers to the electrostatic latent image on the photosensitive member;

a transfer member configured to transfer the developers on the photosensitive member to a transfer medium by nipping the transfer medium between the photosensitive member;

a charging control unit configured to apply a charging bias having the same polarity as a charged polarity of the developers to the charging member;

a transfer control unit configured to apply a transfer bias having a reverse polarity to the charged polarity of the developers to the transfer member, and a developing control unit configured to apply a developing bias having the same polarity as the charged polarity of the developers to the developer carrier, wherein the image forming apparatus collects developers, which remain on the photosensitive member without being transferred to the transfer medium, by the developer carrier and reuses the collected developers, wherein the transfer control unit is configured to set an absolute value of the transfer bias to a first value or a second value smaller than the first value, wherein when the transfer control unit sets the absolute value of the transfer bias to the first value, the charging control unit sets an absolute value of the charging bias to a third value, and wherein when the transfer control unit sets the absolute value of the transfer bias to the second value, the charging control unit sets the absolute value of the charging bias to a fourth value smaller than the third value, wherein the charging control unit is configured to set a value of the charging bias based on a value of the transfer bias from the transfer control unit, and the developing control unit is configured to set a value of the developing bias based on the value of the charging bias from the charging control unit.

2. The image forming apparatus according to claim 1, wherein when the charging control unit sets the absolute value of the charging bias to the third value, the developing control unit sets an absolute value of the developing bias to a fifth value, and wherein when the charging control unit sets the absolute value of the charging bias to the fourth value, the developing control unit sets the absolute value of the developing bias to a sixth value smaller than the fifth value.

3. The image forming apparatus according to claim 2, wherein the transfer control unit switches the transfer bias in response to a signal that is input by a operation by a user.

4. The image forming apparatus according to claim 1, wherein the transfer control unit switches the transfer bias in response to a signal that is input by a operation by a user.

5. The image forming apparatus according to claim 1, further comprising a humidity sensor, wherein the transfer control unit switches the transfer bias in response to a humidity detected by the humidity sensor.

6. The image forming apparatus according to claim 5, wherein when the humidity detected by the humidity sensor is smaller than a predetermined value, the transfer control unit sets the absolute value of the transfer bias to the first value, and wherein when the humidity detected by the humidity sensor is equal to or larger than the predetermined value, the transfer control unit sets the absolute value of the transfer bias to the second value.

* * * * *